US009055616B2

(12) United States Patent
Ziegler

(10) Patent No.: US 9,055,616 B2
(45) Date of Patent: Jun. 9, 2015

(54) METHOD AND APPARATUS FOR INDUCTIVELY HEATING AN ELECTRICALLY CONDUCTIVE WORKPIECE

(75) Inventor: Patrick Ziegler, Zufikon (CH)

(73) Assignee: Soudronic AG, Bergdietikon (CH)

( * ) Notice: Subject to any disclaimer, the term of this patent is extended or adjusted under 35 U.S.C. 154(b) by 2044 days.

(21) Appl. No.: 12/202,509

(22) Filed: Sep. 2, 2008

(65) Prior Publication Data

US 2009/0078697 A1 Mar. 26, 2009

(30) Foreign Application Priority Data

Sep. 21, 2007 (CH) ..... 1472/07

(51) Int. Cl.
*H05B 6/10* (2006.01)
*H05B 6/36* (2006.01)

(52) U.S. Cl.
CPC ..... *H05B 6/101* (2013.01); *H05B 6/365* (2013.01)

(58) Field of Classification Search
CPC ..... H05B 6/365; H05B 6/101
USPC ..... 219/640, 642, 661, 603, 654, 659, 662, 219/673; 156/380.2, 380.6
See application file for complete search history.

(56) References Cited

U.S. PATENT DOCUMENTS 3,187,155 A * 6/1965 Beckert et al. ..... 219/642
4,311,896 A * 1/1982 Junya ..... 219/642
4,740,663 A * 4/1988 Roth et al. ..... 219/660
5,101,086 A 3/1992 Dion et al.
5,444,220 A * 8/1995 Hansen et al. ..... 219/633
5,690,851 A 11/1997 Yoshioka et al.
7,022,951 B2 * 4/2006 Larive et al. ..... 219/619
2005/0247704 A1 * 11/2005 Loveless et al. ..... 219/661
2006/0219709 A1 * 10/2006 Kagan ..... 219/661

FOREIGN PATENT DOCUMENTS

DE 30 40 763 A1 5/1981
JP 11-219778 8/1999
JP 2001-189222 7/2001
WO 2006042426 A1 4/2006
WO 2006053457 A2 5/2006

OTHER PUBLICATIONS

Swiss Search Report of Swiss priority application 1472/07.

* cited by examiner

*Primary Examiner* — Jianying Atkisson

(74) *Attorney, Agent, or Firm* — McCormick, Paulding & Huber LLP

(57) ABSTRACT

An apparatus for inductively heating an electrically conductive workpiece in the form of a closed ring includes a U-shaped magnet core with two legs, an electrically conducting coil arranged on at least one leg of the core and connectable with an alternating current source, and a magnet yoke spaced from at least one freestanding end of a leg of the core, so that a closed magnetic circuit with at least one air gap is formed, with the height of the air gap chosen such that the workpiece can be moved in a non-contacting manner into the air gap.

12 Claims, 2 Drawing Sheets

METHOD AND APPARATUS FOR INDUCTIVELY HEATING AN ELECTRICALLY CONDUCTIVE WORKPIECE

REFERENCE TO RELATED APPLICATION

This application claims the priority of Swiss Patent Application No. 1472/07, which was filed on 21 Sep. 2007, and the entire disclosure of which is incorporated herewith by reference.

TECHNICAL FIELD

The invention concerns a method and apparatus for inductively heating an electrically conductive workpiece, which workpiece is made in the shape of a closed ring, according to the preamble of the independent claims. With regard to a workpiece which is formed as a closed ring, it is to be understood that this terminology is to mean any workpiece which surrounds an opening, for example, a ring shaped workpiece or an elliptical, rectangular, or square workpiece that surrounds an opening, which opening likewise can be of elliptical, rectangular or square shape. The workpiece especially can be a cover blank, having a completely surrounded opening, such as is used for making a cover with a tear-off or pull-off foil.

BACKGROUND OF THE INVENTION

A method and apparatus for the making of covers with a foil is known from patent application WO 2006/042426 A1. The known apparatus has a conveyor device and several processing stations and a testing station. The conveyor device delivers cover blanks to the individual processing stations and to the test station. In a first processing station, a cover blank is created with a completely surrounded opening, insofar as by a stamping process an opening is stamped into a disc. In the next processing station, the inner edge of the cover blank is drawn downwardly. In the following processing station a foil having a flap is placed over the surrounded opening of the cover blank and is fastened to the blank by heat sealing. The foil for this is provided on its underside with a layer of plastic material and is stamped from a broad foil web. The foil is then placed over the surrounded opening, which can also be referred to as a middle recess, and is pressed to the edge of the surrounded opening under the effect of heating so that the foil is sealingly connected to the cover blank by the melting and subsequent cooling of the plastic material layer. An additional processing station for cooling can be provided. Then in a further processing station, the foil is provided with an embossing and the inner edge of the cover blank now located below the foil is beaded. Finally, the now finished cover is subjected to a test in a testing station which testing includes a test of the sealing tightness of the foil applied to the cover.

As described in patent application WO 2006/053457 A2 the foil can be so sealed or adhered to the cover ring insofar as in a first step the sealing or adhering is partially accomplished and in a second step is completed, with by the second step the connection between the foil and the cover blank being entirely reinforced. The sealing or adhering takes place by heat effect. The partial sealing or adhering is so created that the sealing or adhesion takes place in only predetermined partial areas and/or because of insufficient heat effect is not entirely carried out. The temperature for the sealing or adhesion in the first step and/or in the second step has preferably a value of about 200° C.

Based on the principal of induction heating, it is known to create heat in an electrically conducting workpiece by means of an inductor which typically includes a U-shaped magnet core with two legs, with each leg having wound onto it an electrically conducting coil connected to a source of electric current. The legs of the U-shaped magnet core carrying the coils represent the magnet poles. The inductor thereby forms an open magnetic circuit. To heat a workpiece the poles are held close to the outer surface of the workpiece to be heated. With the supply of an alternating current, a magnetically alternating field is created under the influence of which in the outer surface of the workpiece high frequency eddy currents are created so that heat in the form of eddy current loses (so called "skin effect") is created. This is for example used for the warming of a container wall (see U.S. Pat. No. 5,690,851 A). Corresponding inductors are for example also known from U.S. Pat. Nos. 5,101,086 A and 7,022,951 B1. The thinner the wall of a workpiece the greater must be the frequency of the alternating current source and with it the frequency of the created alternating magnetic field, so that the eddy currents created in the workpieces are close to a sufficiently large electrical resistance, so as to create sufficient heat by the eddy current losses.

From U.S. Pat. No. 4,740,663 A an inductive heating unit is known by means of which electrical energy can be induced into the metallic periphery of a metal foil carrier of a cover for a container so that the cover is heated and is heat connected with the container. The induction heating unit has a magnetic core with two opposed U-shaped sections with one coil being arranged inside of one section. The cover is clamped to the opposed legs of one side of the magnetic core, while an air gap is formed with the other side of the magnetic core. This provides a closed magnetic circuit with each of the opposed legs forming a pole. In the cover lying between the legs of one side of the magnetic core by eddy currents and magnetic reversing loss a partial heating is obtained. The cover which connects the two legs of one pole of one side of the magnetic core with one another so to speak short-circuits the magnetic field between the two poles of the magnet circuit. The known devices for inductive heating, which are also known as inductors, are supplied with high frequency energy and typically for each workpiece a certain size of inductor with suitable tolerances is required. Also different materials often require different types of inductors, as for example, is the case with workpieces made of aluminum in comparison to workpieces made of steel alloy, since this material especially strongly influences the coupling. If the inductor is to be used with an apparatus with a conveyor, it can happen that with known induction the typically metallic guide rails of the conveyor can come under the effect of an inductor arranged near a workpiece and can likewise become heated.

SUMMARY OF THE INVENTION

The object of the present invention is to provide a method and apparatus for inductive heating by means of which electrically conductive workpieces, which are in the shape of a closed ring, of different materials and different dimensions and sizes, can be uniformally heated.

By way of a workpiece in the form of a closed ring it is meant a workpiece having a totally surrounded opening, that is an opening which is entirely surrounded by an edge, as for example ring shaped workpieces or workpieces of elliptical, rectangular or square shape which have a surrounded opening, which opening likewise can be circular, elliptical, rectangular or square. Such workpieces are for example cover blanks for the making of covers which are provided with a foil, especially a tear off or pull off foil, that is a foil having a flap for the tearing off or pulling off, with the foil as previously described being applied to the cover blank by sealing or adhesion.

The object is solved by an apparatus for inductive heating and by a method for inductive heating as defined hereinafter. The device of the invention for inductive heating can also be called an inductor.

The device of the invention for inductive heating includes a U-shaped magnetic core with two legs and with at least one electrically conducting coil being arranged on at least one leg of the U-shaped magnet core, which coil is connectable to an alternating current source and which coil especially surrounds the leg. The device of the invention is distinguished in that a magnet yoke is provided which is spaced from at least one freestanding end of one of the legs of the U-shaped magnet core so that a closed magnetic circuit with at least one air gap is formed. The height of the at least one air gap, and preferably of both air gaps, is so chosen that an electrically conducting workpiece can be non-contactingly introduced through the air gap. The term U-shaped magnetic core is to be understood to also include a C-shaped magnetic core. A magnet core can especially be a ferrite core.

According to a preferred implementation of the apparatus of the invention at least one electrically conducting coil is arranged on each leg of the U-shaped magnetic core, with the coils being wound in opposite directions and being connectable to an alternating current source. Further the magnet yoke is spaced from the freestanding ends of both legs of the U-shaped magnetic core so that a closed magnetic circuit with two air gaps is formed.

The surfaces or the cross-sectional surfaces of at least the leg in which the at least one air gap is arranged, through which air gap the electrically conducting workpiece is insertable, are preferably so formed that they can fit through the surrounded opening in the electrically conductive workpiece. In this way, the workpiece can be so positioned in the air gap that on all sides it extends away from the air gap, that is it surrounds the air gap. The workpiece as located in this way for the inductive heating is thereby located outside of the air gap and thereby outside of a zone of high magnetic field strength.

The method of the invention is characterized in that with the use of an apparatus of the invention an electrically conductive workpiece in the shape of a closed ring is moved without contact with the apparatus into the air gap, so that the workpiece surrounds the air gap and a closed opening in the workpiece lies at least partially in the air gap, and the coils of the apparatus of the invention are supplied with an alternating current, that is are connected to an alternating current source. This description of the steps of inventive method are not to be taken to represent any particular chronological sequence, so that the coils for example can also be provided with an alternating current before the workpiece is inserted into the air gap.

In a production operation, the apparatus of the invention is preferably operated continuously so that the coils of the inventive device are constantly supplied with alternating current. In this way, a strong steering and a transient delay of the device of the invention can be avoided. The workpiece or its edges are then during the insertion into the air gap at least partially subjected to the alternating field appearing in the air gap, which however, with a correspondingly small effective time period, is negligible.

The method of the invention and the apparatus of the invention can be especially used with advantage for the heating of flat workpieces, with a flat workpiece also being taken to be a thin workpiece. The apparatus and method of the invention are advantageously suited for the insertion of a workpiece, which surrounds the air gap at a wide spacing from the gap.

The alternating current source can also be referred to as a generator. Preferably a low frequency and therefor economical alternating current source is used. Further the use of a low frequency has the advantage that the coil losses are small and long conductors can be used. Since as the working frequency a low frequency can be used it is therefore made especially possible that the method and apparatus of the invention essentially are not based on the skin effect.

In that the apparatus of the invention is operated at a relatively low frequency, which preferably lies between 18 and 40 kilohertz, it is possible to position and drive the apparatus without the use of a transformer at a great distance from the alternating current source, for example at a spacing of 20 meters.

If the coils are connected with an alternating current source, there is an accompanying change in the magnetic field strength of the magnetic circuit, which is formed by the U-shaped magnet core and the magnet yoke and the coils, which leads to a change in the flux density. Because of this change in the flux density, in the workpiece an induced electromotive force is induced in accordance with the following induction law, which electromotive force is essentially independent of the dimensions of the workpiece, especially from the diameter of a ring shaped workpiece:

$$U_{ind} = -\frac{d\Phi_{magn}}{dt} = -\frac{d}{dt}\int_A \vec{B}\cdot\overrightarrow{df}$$

where $U_{ind}$ is the induced electromotive force, $\Phi_{magn}$ is the magnetic flux, t is time, B is the flux density, A is the surface through which the magnetic field passes and which is surrounded by the workpiece taken as a constant, and f is the surface taken as a variable. It is assumed that the magnetic flux $\Phi_{magn}$ changes with time t. In the given equation the winding number or the winding number of the spools is already taken into consideration by the magnetic flux or is contained within that flux.

The electric resistance, which can also be referred to as impedance or alternating current resistance, of the electrically conducting workpiece in the form of a ring is larger than zero so that an electromotive force is induced. In the case of a ring-shaped workpiece the electrical resistance can also be referred to as ring impedance. The electrical resistance has, with an electrical current in the workpiece, the result of producing a uniform or homogenous warming or heating of the workpiece. Advantageously there results in the apparatus of the invention and in the method of the invention, a heat generation in the workpiece which is essentially not by way of skin effect at an outer surface of the workpiece or by way of magnetic reversal loss.

By way of the apparatus and method of the invention workpieces of different dimensions or sizes which surround the air gap can be heated uniformly and essentially independently of the spacing between the apparatus or its air gap and the workpiece, when the workpiece surrounds the air gap. A same apparatus of the invention can be used for workpieces of different dimensions. The geometry of the apparatus of the invention and of the magnetic alternating field created by the apparatus of the invention need not be suited to a workpiece so long as the workpiece surrounds the air gap.

The apparatus of the invention can for example be used to heat a cover blank with a totally surrounded opening especially with or in a system for the making of covers provided with a foil. One such system typically has a conveyor/transport system or a guide system for the delivering and guiding of cover blanks and different processing stations for the processing of cover rings (see WO 2006/042426 Al as previously described) and is implemented as a line production system.

Accordingly, the method of the invention can be used for the heating of a cover blank having a totally surrounded opening, especially with or in a system for the making of covers with foils. Since the apparatus of the invention is essentially independent of the workpiece shape and size—disregarding the size and dimensions of the surrounded opening—the apparatus of the invention can be so made spacewise that it does not come into conflict with the conveying device and/or the processing stations of a system for the making of foil provided covers. By way of the apparatus of the invention, a closed magnetic circuit with two air gaps is formed, which has as a result an essentially closed guiding of the magnetic field, disturbing emissions are minimized and the conveyor device is subjected to only very weak magnetic fields, so that a heating of the conveying device is practically avoided or made negliable.

In the case of the making of covers with a foil, a cover blank is advantageously heated by means of the inventive apparatus and the inventive method by way of a prewarming for a sealing or adhesion with a foil. After the prewarming there then takes place the application of a foil to the workpiece so that the surrounded opening of the workpiece is closed by the foil, by way of the sealing or adhesion, with preferably a presealing/preadhesion step and after the presealing/preadhesion step a following main sealing/adhesion step (see WO 2006/053457 A2). With the prewarming by means of inductive heating for example ring shaped or square shaped workpieces with a totally surrounded opening and made of a steel alloy or aluminum, in a system for the making of covers with foils and which includes a conveyor device, can be uniformly heated contact free in several hundred milliseconds to about 80° C. The sealing/adhesion or the main sealing/adhesion following the presealing/preadhesion, can then take place preferably at about 200° C. By way of the inductive preheating, the quality of the subsequent main sealing adhesion can be increased and, according to the material of the foil, the production rate can be increased since the additional prewarming leads to an efficient energy transfer. It is recommendable in the case of such a system for the making of covers with foils in or with the inventive apparatus and the inventive method, that the neighborhood of the workpieces be insulated, and especially that a conveyor device be insulated for example by making the conveyor belts of the conveyor device out of plastic.

BRIEF DESCRIPTION OF THE DRAWINGS

Further advantageous implementations of the invention will be apparent from the dependent claims and especially from the following drawings illustrating exemplary embodiments. The drawings are:

In the figures, the same reference numbers indicate the same structural and functionally similar and similarly operating components.

DESCRIPTION OF THE PREFERRED EMBODIMENTS

Figure 1:
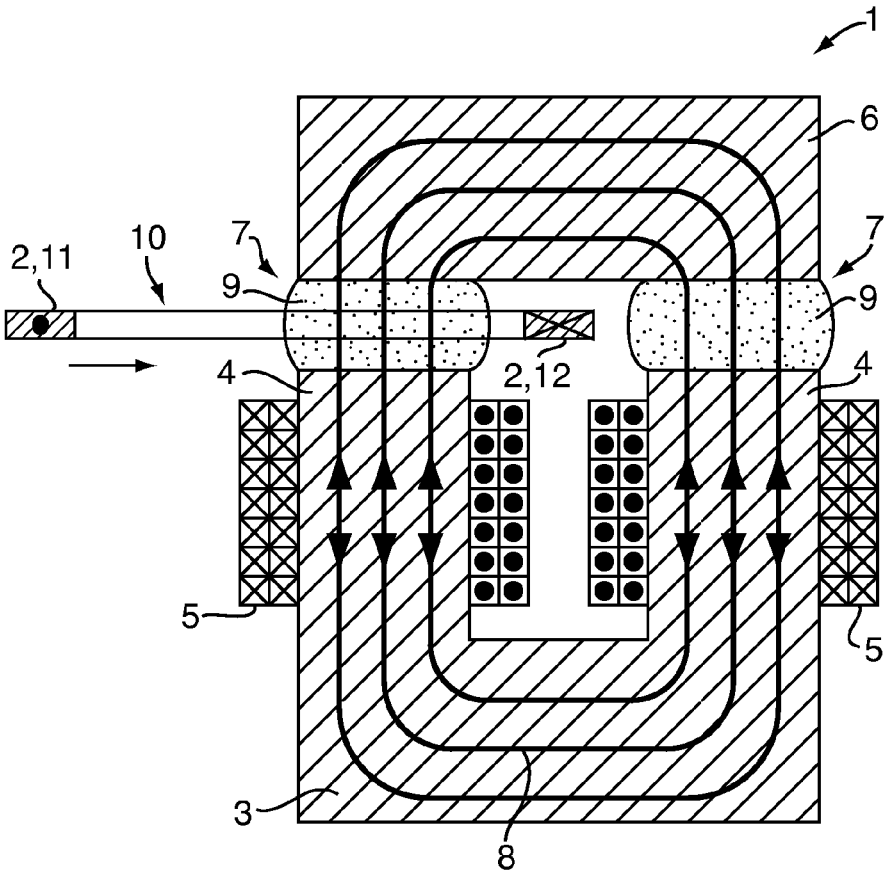
FIG. 1 a schematic cross sectional illustration of a device according to the invention with a workpiece, and FIG. 2 a cross section through the inventive apparatus illustrated in FIG. 1 and at the position of the workpiece.
Figure 2:
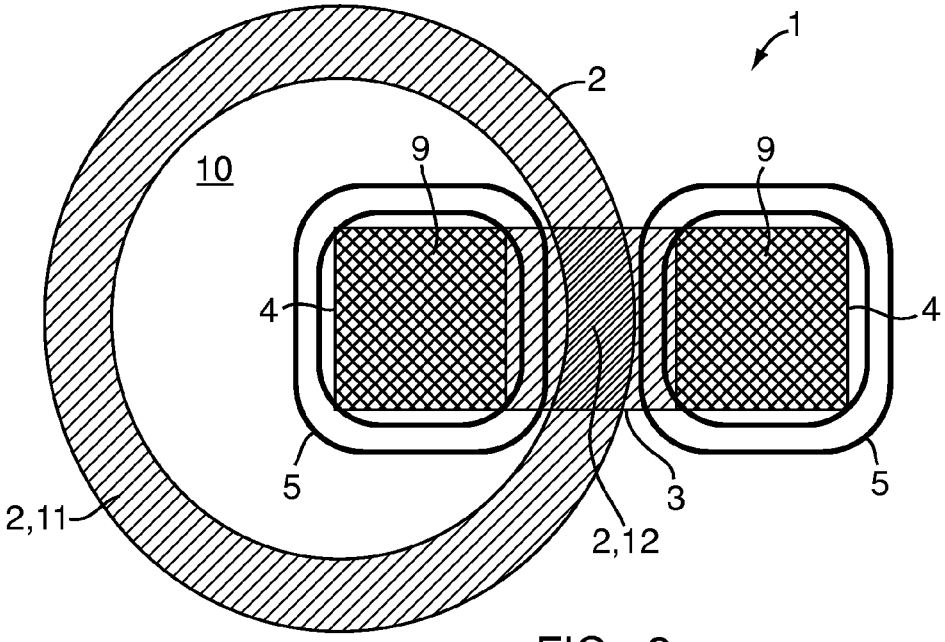

FIGS. 1 and 2 show an apparatus 1 of the invention into which an electrically conducting, for example ring shaped, workpiece 2 has been inserted. Of course the workpiece 2 can also have another shape, for example a rectangular shape with a totally surrounded opening.

The apparatus 1 has a U-shaped magnetic core 3. Within the meaning of U-shaped it is to be understood that the magnet core 3 could also be a C-shaped magnet core. The magnet core 3 can be made from the material N87. Preferably the magnet core 3 is made from the material N87. On each of the legs 4 of the magnet core 3 is a coil 5, with the two coils 5 being wound in opposite directions. This winding scheme is illustrated in FIG. 1 by the cross symbols and the dot symbols in the coils 5, the point symbols of a coil 5 indicating current coming out of the viewing plane towards the viewer and the cross symbols indicating current flowing toward the viewing plane.

Each coil 5 is preferably formed by a high frequency cable with a pregiven reaving of individual strands, there being at least 500 individual strands; and, as especially preferred, 1000 individual strands. Each coil 5 has preferably 14 turns or convolutions.

The apparatus 1 further has a magnet yoke 6 (not illustrated in FIG. 2), which is arranged to form air gaps 7 at a spacing from the not more specifically indicated freestanding ends of the legs 4 of the U-shaped magnet core 3. The height of the air gaps 7 is so chosen that the workpiece 2 can be moved through one air gap 7 so as to become positioned in the vertical direction between the magnet core 3 and the magnet yoke 6. The air gaps 7 preferably have a height of 6.5 millimeters. The device 1 of the invention accordingly forms a closed magnetic circuit with two air gaps 7.

The magnet yoke 6 is preferably I-shaped. It can, however, also be formed with a U-shape, which is to be taken to include also a C-shaped implementation. With such a non-illustrated U-shaped implementation, the freestanding ends of the legs of the magnet yoke 6 are arranged to respectively stand opposite to the freestanding ends of legs 4 of the magnet core 3 so as to form the air gaps 7. Especially, if only a single air gap 7 is provided, the magnet yoke 6 can also be formed to have an L-shape.

The magnet core 3 and the coils 5 are preferably coated with an electrically insulating sealing material to mechanically and chemically protect the magnet core 3 and the coils. The utilized sealing material is in particular heat conducting with it preferably having a minimum heat conductivity of 0.6 W/ (m-K).

To increase efficiency, the magnet core 3 can be cooled, in particular with water cooling (not illustrated).

When the coils 5 are connected to a non-illustrated alternating current source or generator an alternating magnetic field 8 is created in the apparatus 1 of the invention. Each of the legs 4 about which a coil 5 is wound represents a pole of a magnetic circuit with the polarity of the individual poles alternating in dependence on the polarity of the alternating current. In FIG. 1 the alternating magnetic field is indicated for example by field lines 8. In and close to the air gaps 7 exist regions of high magnetic field intensity 9.

The workpiece 2 is moved through one air gap 7, or transported and positioned, so that its totally enclosed opening 10 lies at least partially in the air gap 7 and so that the workpiece 2 itself surrounds the air gap 7, that is the workpiece itself lies outside of the air gap 7. Accordingly, one region 11 of the workpiece lies outside of the apparatus 1 while a further region 12 of the workpiece in the horizontal direction lies between the poles formed by the legs 4 with the surrounding coils 5, while in the vertical direction the workpiece lies in the air gap 7 between the magnet core 3 and the magnet yoke 6. The further region 12 therefore lies in an area of low field strength between the two poles of the magnet core 3. The workpiece 2 therefore surrounds the alternating field conducted in the magnet core 3 and in the magnet yoke 6; and by that alternating field, as previously described, a voltage is induced in the workpiece 2 which is essentially independent of the dimension of the totally surrounded opening 10 of the workpiece 2

So that the field strength between the poles of the magnet core 3 is as low as possible, and so that outside of the air gaps 7 at most only small disturbance emissions appear, the air gaps 7 are made to be of an as small as possible height, particularly with a height of 6.5 millimeters. Accordingly, the apparatus of the invention is especially suited for flat workpieces 2, that is for workpieces 2 with a small vertical dimension. As a flat workpiece 2 is also meant a thin workpiece.

The inventive apparatus 1 and the workpiece 2 correspond basically to a transformer with a very large air gap with the apparatus 1 representing the primary winding and the workpiece 2 representing a short circuited secondary winding of the transformer.

The alternating current source or generator for supplying the coils 5 generates preferably a current having a low frequency, especially with a frequency in the range of from 18 to 40 kilohertz, so that the alternating current source or generator can have a switching oscillating circuit. The current created by the alternating current source or generator has preferably and rms value (effective value) of about 10 to 25 ampere. If no workpiece 2 is in the apparatus 10, so that the apparatus 10 is in idle operation, this will have the result of a lowering of the resonant frequency of the apparatus 1, the apparatus 1 preferably being connected with a alternating current source having some capacitance so that the system consisting of the apparatus 1 and the non illustrated alternating current source will automatically become unloaded.

Figure 3:
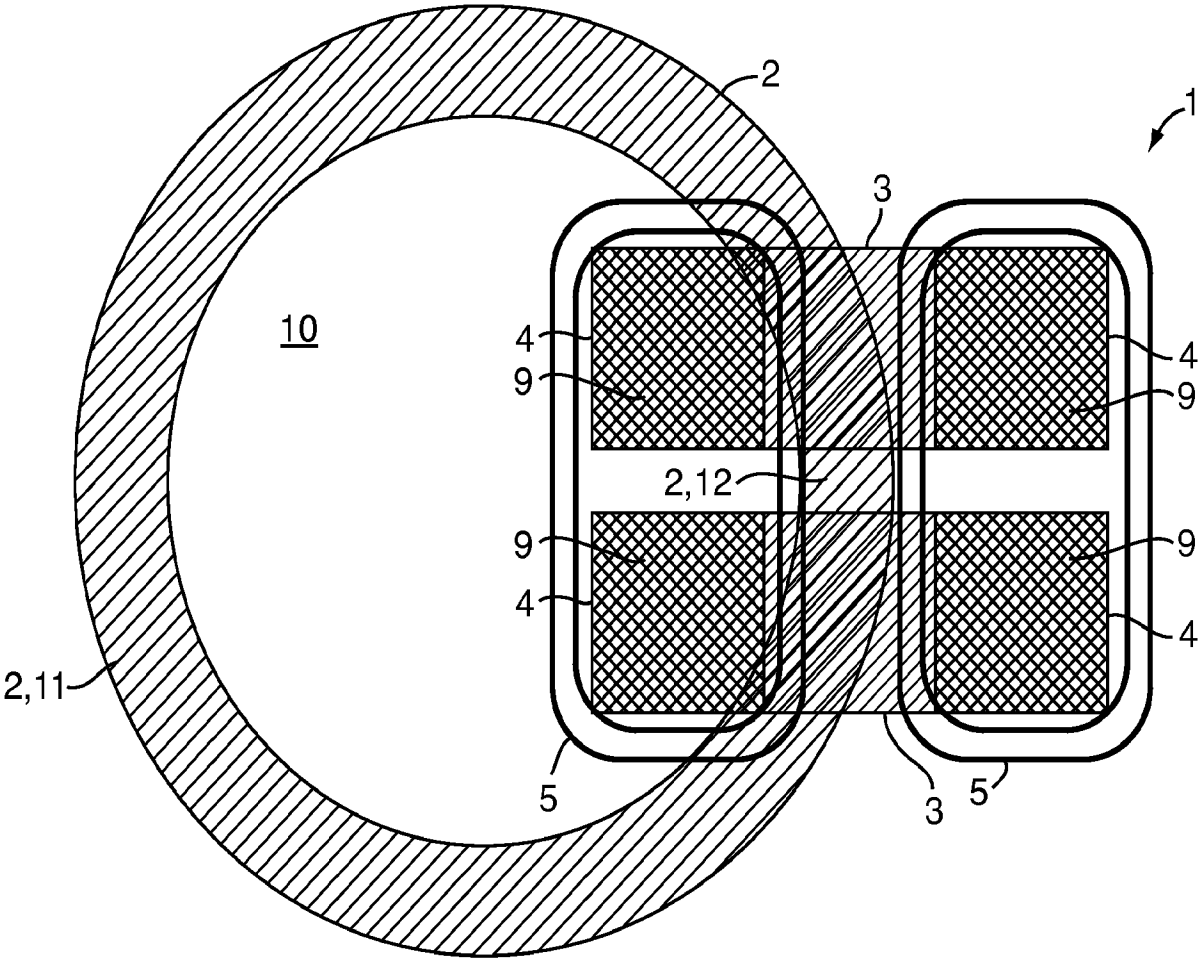
FIG. 3 a schematic cross sectional illustration of a device according to the invention with a workpiece.

According to the embodiment of the apparatus of the invention shown in FIG. 3, a further second U-shaped magnet core can be provided next to the first U-shaped magnet core 3 with the coils 5 which are on the legs 4 of the first U-shaped magnet core 3 also being arranged on the legs of the further second U-shaped magnet core. That is, in this embodiment, the coils 5 surround the legs of both U-shaped magnet cores. The further or second U-shaped magnet core has preferably the same dimensions as the first U-shaped magnet core which is provided in the first embodiment of the inventive device as described in connection with FIGS. 1 and 2. As is shown in FIG. 3, the further or second U-shaped magnet core is likewise associated with an I-shaped or U-shaped magnet yoke with this second magnet yoke being arranged next to the first magnet yoke 6 of the embodiment of the invention apparatus described in connection with FIGS. 1 and 2, so that air gaps are provided with a larger cross section than in the case of an inventive apparatus 1 with only one magnet core 3 and only one magnet yoke 6. Of course the first magnet yoke 6 can also be made so wide that it extends over both the magnet cores and forms air gaps with the two magnet cores.

With embodiments of the inventive apparatus such as the embodiment shown in FIG. 3 workpieces with very large diameters and/or workpieces which are made from a material with small specific resistance or which contain such material, can be heated. Also in this case it will be taken that the workpieces each have a totally surrounded opening which can be made to lie at least partially in one of the air gaps of this further embodiment and that the workpiece will surround the air gap. The available heating power in the case of the embodiment illustrated in FIG. 3, in which the two magnet cores are placed next to one another and are wound by the same two coils, in comparison to the first embodiment of the invention illustrated in FIGS. 1 and 2, is increased. The necessary turns or convolutions of the coils can accordingly be reduced by a factor of $\sqrt{2}$, i.e., the square root of 2, so that instead of 14turns/convolutions as in the first embodiment of FIGS. 1 and 2, the second embodiment of FIG. 3 can have 9 or 10 turns/convolutions per coil. By the lowering of the required winding turns/convolutions the amount of copper loss is reduced in an advantageous way (the coils being typically made of copper) and the loading of the magnet core by way of saturation effect can be significantly reduced so that the apparatus of the invention exhibits low heat loss. Because of the lower loss in the magnet core the apparatus can be operated with a higher field strength of the magnetic alternating field.

While in the present application preferred embodiments or implementations of the invention have been described, it is to be clearly understood that the invention is not limited to these embodiments and that the invention can be carried out in other ways within the bounds of the following claims.

The invention claimed is:

1. A device for inductively heating an electrically conductive workpiece (2) made in the form of a closed ring, wherein the device has a first U-shaped magnet core (3) with two legs (4) and at least one electrically conducting coil (5) wound around at least one of the legs (4) of the first U-shaped magnet core (3) and connectable with an alternating current source, wherein a magnet yoke (6) is provided in spaced relation to at least one freestanding end of one of the legs (4) of the first U-shaped magnet core (3) so that a closed magnetic circuit with at least one air gap (7) between the at least one freestanding end and the magnet yoke is formed, and wherein the height of the at least one air gap (7) is chosen to permit the electrically conducting workpiece (2) to be moved in a non-contacting manner through the air gap (7).

2. The device according to claim 1, wherein the at least one electrically conducting coil (5) is wound around each leg (4) of the first U-shaped magnet core (3), with the coils (5) being wound in opposite directions and with both of those coils being connectable to an alternating current source, and wherein the magnet yoke (6) is provided in spaced relation to both of the freestanding ends of the two legs (4) of the first U-shaped magnet core so that a closed magnetic circuit having air gaps (7) between the magnet yoke and each of the freestanding ends is formed.

3. The device according to claim 1, wherein a face of the at least one leg (4) which is associated with the at least one air gap (7), through which the electrically conducting workpiece (2) is movable, is so formed that it fit into the closed opening (10) in the electrically conductive workpiece (2).

4. The device according to claim 1, wherein the magnet yoke (6) is I-shaped or U-shaped.

5. The device according to claim 1, wherein the at least one coil (5) comprises a cable.

6. The device according to claim 1, wherein the first U-shaped magnet core (3) and the at least one coil (5) are coated with an electrically insulating sealing material.

7. The device according to claim 1, wherein the first U-shaped magnet core (3) is provided with cooling.

8. The device according to claim 1, wherein the device further comprises a second U-shaped magnet core next to the first U-shaped magnet core, and wherein the at least one electrically conducting coil is wound around the at least one leg (4) of the first U-shaped magnet core (3) and is also wound around at least one leg of the second U-shaped magnet core.

9. A use of the device according to claim 1 for warming a cover blank with a totally surrounded opening.

10. A method for inductively heating an electrically conducting workpiece (2) which is made in the shape of a closed ring, using a device (1) according to claim 1, the method comprising the following steps:

in a non-contacting manner inserting the workpiece (2) into an air gap (7) so that the workpiece (2) surrounds the air gap (7) and so that a totally enclosed opening (10) of the workpiece (2) lies at least partially within the air gap (7), and providing the coils (5) of the device with alternating current.

11. The method according to claim 10, wherein the method is used for heating a cover blank with a totally surrounded opening.

12. The method according to claim 11, wherein the cover blank is heated prior to being sealed or adhered to a foil.

* * * * *